United States Patent [19]

Weber

[11] 4,070,218

[45] Jan. 24, 1978

[54] METHOD OF PRODUCING A SOFT, NONWOVEN WEB

[75] Inventor: Robert E. Weber, Appleton, Wis.

[73] Assignee: Kimberly-Clark Corporation, Neenah, Wis.

[21] Appl. No.: 678,161

[22] Filed: Apr. 19, 1976

Related U.S. Application Data

[62] Division of Ser. No. 626,252, Oct. 28, 1975, Pat. No. 3,973,068.

[51] Int. Cl.[2] ..... D04H 3/16

[52] U.S. Cl. ..... 156/167; 156/181; 156/289; 156/290; 156/306; 156/344; 264/211; 264/300

[58] Field of Search ..... 156/167, 290, 181, 286, 156/289, 181, 306, 344; 428/198, 196; 264/211, 130, 136, 176 F, 249, 248, 300, 210 F; 429/250; 252/8.6, 8.9

[56] References Cited

U.S. PATENT DOCUMENTS

| | | | |
|---|---|---|---|
| 3,575,856 | 4/1971 | Anton | 252/8.6 |
| 3,855,045 | 12/1974 | Brock | 156/181 |
| 3,870,567 | 3/1975 | Palmer et al. | 156/306 |
| 3,959,560 | 5/1976 | Sturwold et al. | 252/8.6 |
| 3,988,410 | 10/1976 | Larson et al. | 156/167 |

*Primary Examiner*—Charles E. Van Horn
*Assistant Examiner*—Michael W. Ball
*Attorney, Agent, or Firm*—D. J. Hanlon, Jr.; William D. Herrick; Raymond J. Miller

[57] ABSTRACT

A soft, nonwoven web is produced by adding directly to a thermoplastic polymer at the time of extrusion a lubricating agent having an HLB number in the range of 8 to 20 and a molecular weight in the range of from 200 to 4000. The lubricating agent is uniformly distributed into the polymer as extruded into filaments. The filaments are collected to form a web and then subjected to heat treatment in the range of from 180–260° F. for at least about 1–7 seconds. The lubricating agent migrates to the surface of the fibers producing a release effect and preventing secondary bonding from occurring. After pattern bonding to provide spaced areas of high intensity bonds, the result is a soft, strong nonwoven web having particular utility as a liner for disposable diapers and catamenial devices.

8 Claims, 1 Drawing Figure

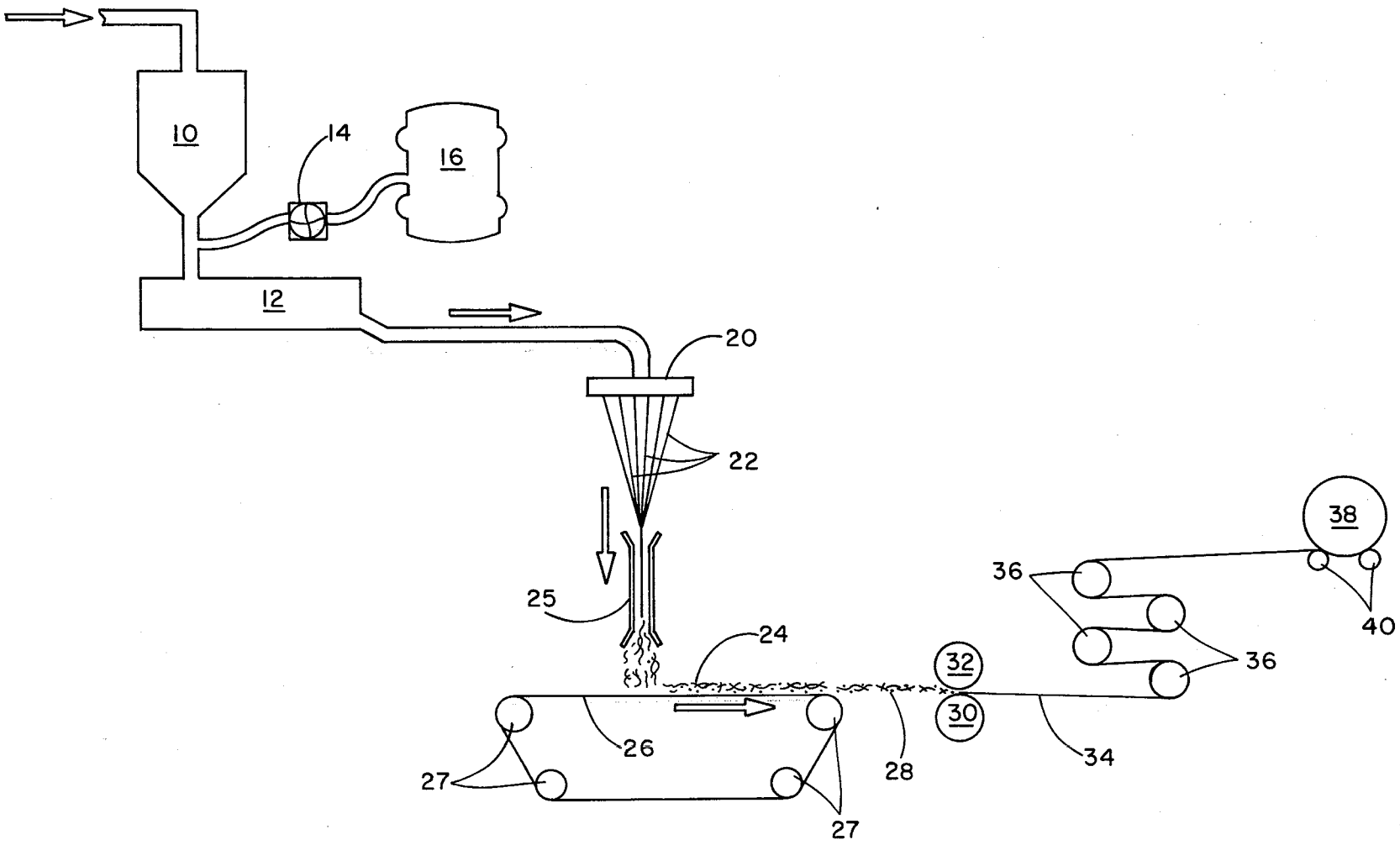
10
12
14
16
20
22
24
25
26
27
27
28
30
32
34
36
36
38
40

METHOD OF PRODUCING A SOFT, NONWOVEN WEB

This is a division of application Ser. No. 626,252, filed Oct. 28, 1975, now U.S. Pat. No. 3,973,068.

BACKGROUND OF THE INVENTION

1. Field of the Invention

This invention pertains to nonwoven webs formed by extruding filaments of thermoplastic polymers and collecting them into a sheet which is then bonded to provide strength and structural integrity. While such webs are currently available, they tend to be stiff and paper-like when compared to woven textiles of similar basis weight. Particularly in applications where the material is to be placed in contact with a person's skin such as disposable diapers and catamenial devices, for example, this stiff paper-like feeling is perceived as a disadvantage. A number of attempts have been made to soften the nonwoven webs as formed by chemical or physical treatment. However, such attempts have not been entirely satisfactory due to the added cost involved or the resulting adverse effect on other web properties.

Accordingly, it is desired to economically produce a soft, nonwoven web without deleterious side effects. The present invention is directed to such a method.

DESCRIPTION OF THE PRIOR ART

U.S. Pat. No. 3,692,618 issued Sept. 19, 1972 to Dorschner et al. describes a process for forming continuous filament nonwoven webs. In this process a number of continuous filaments of a synthetic polymer such as polypropylene are simultaneously spun and gathered into a straight row of side-byside untwisted bundles. These bundles are drawn downwardly at a high velocity in an individual surrounding gas column and directed to impinge on a carrier belt moving so that the bundles extend in a straight row across the carrier at an angle to the direction of its movement. As the bundles impinge against the carrier they are divided and deposited in a loop-like arrangement extending back and forth across the direction of travel of the carrier to form a web which is characterized by a multiple number of side-by-side lengthwise sections.

U.S. Pat. No. 3,855,046 issued Dec. 17, 1974 to Hansen et al. describes bonding of nonwoven webs of the type produced according to the Dorschner et al patent. In accordance with the Hansen et al method webs having releasable bonds are formed by passing the web through a nip formed by an anvil roll and a roll having a plurality of raised points in a pattern selected to yield the web with adequate integrity and tensile strength.

U.S. Pat. No. 3,855,045 issued Dec. 17, 1974 to Brock describes a further bonding embodiment wherein the resulting web has self-sizing characteristics. Such webs are generally of heavier basis weight in the range of 1–3 ounces per square yard and are characterized by primary bonds in discrete compact areas and secondary bonds in the remaining surface. The secondary bonds provide stiffness and strength required for web processing in applications such as the manufacture of bed linens, garments, drapery materials, etc. Upon washing, however, the secondary bonds are disrupted producing increased softness and improved tactile properties such as hand, drape and the like.

U.S. Pat. No. 3,870,567 issued Mar. 11, 1975 to Palmer et al. is directed to a battery separator produced from nonwoven microfiber mats made wettable through the incorporation of an internal wetting agent which tends to bloom under conditions of use. The preferred wetting agents have an HLB (hydrophilic lypophilic balance) less than 5. However, an additional wetting agent having a higher HLB number can be incorporated to provide a higher degree of wetting.

SUMMARY

The present invention is directed to an improved method of forming soft, nonwoven fabrics and the resulting webs. In accordance with the invention, a latent lubricant is incorporated into a thermoplastic polymer and the mixture extruded to form filaments which are collected into a self-supporting web. In subsequent operations the web is highly bonded in discrete areas and the lubricant caused to migrate to the surface of the filaments. The presence of the lubricant reduces the tendency to form secondary bonds outside the discrete bond areas and results in a high degree of softness, drape, and handle without substantially adversely affecting web strength properties.

Preferred thermoplastic polymers are polyolefins and particularly polypropylene. Preferred lubricating agents are surfactants having an HLB number in the range of from 8 to 20, particularly within the range of from 8 to 18, and, most preferred, within the range of 8.5 to 17, and a molecular weight in the range of from 200 to 4000, particularly in the range of from 300 to 1200, and, most preferred, within the range of 300 to 800, that are only semi-compatible with the thermoplastic polymer. Such additives will, when heated, migrate to the surface lubricating the fibers and reducing the tendency to produce secondary bonds. The resulting fabric will exhibit extremely desirable tactile properties such as softness, drape, and hand while yet remaining strong for applications such as liners for disposable diapers and catamenial devices, for example.

BRIEF DESCRIPTION OF THE DRAWINGS

The sole FIGURE is a schematic representation of the process of the present invention.

DESCRIPTION OF THE PREFERRED EMBODIMENTS

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Turning to the FIGURE, the process of the present invention will be described broadly. As illustrated, silo 10 contains the thermoplastic polymer being fed to extruder 12. Prior to extruder 12, pump 14 supplies lubricating agent from tank 16 which is mixed with the thermoplastic polymer at 18. Alternatively, the lubricating agent may be metered directly into extruder 12 if desired. The action of the extruder 12 thoroughly mixes the lubricating agent and the thermoplastic polymer which are fed to die 20.

Filaments 22 are preferably spun and formed into sheet 24 through duct 25 in the manner generally described in the above-mentioned Dorschner et al patent. Thus, continuous filaments are spun by extruding through a multiple number of downwardly directed spinning nozzles, preferably extending in a row or multiple number of rows. The filaments, as they are spun are gathered into a straight row of side-by-side, evenly spaced apart, untwisted bundles each containing at least 15 and preferably from 50 to 1,000 filaments. These filament bundles are simultaneously drawn downwardly at a velocity of at least 3,000 meters per minute, and preferably from 3500–8000 meters per minute, in individually surrounding gas columns flowing at a supersonic velocity and directed to impinge on horizontal carrier 26 which is driven about rolls 27. The gathering of the filaments into the untwisted bundles and their drawing and directing to impinge on the carrier is preferably effected by passing the bundles through air guns which surround the filaments with a column or jet of air which is directed downward at supersonic velocity. The air guns are arranged so as to extend in one or more rows extending across the carrier at right angles to its direction of movement, so that the bundles confined in the gas columns as they strike the moving carrier extend in a line or row at right angles across the carrier. In order to enhance the intermingling of the bundles, they can be made to oscillate, the plane of oscillation being transverse to the direction of carrier movement. The filaments are laid down in a loop-like arrangement with primary loops extending back and forth across the width of a section defined by the impingement of the air column from one air gun on the carrier. Before and as the parallel filament bundles impinge the carrier, they are broken up into sub-bundles containing a lesser number of parallel filaments and forming secondary smaller loops and swirls. The secondary loops and swirls overlap each other and those of adjacent sections to result in substantially complete intermingling with the overlapping portions of adjacent sections. Thus, the laid down filament bundles form a continuous uniform nonwoven web.

It will be understood that the method of the present invention is equally applicable to the softening of nonwoven webs formed by other spinning techniques.

Bonding of sheet 25 is preferably accomplished in the manner described in the above-mentioned Hansen et al patent. Sheet 24 is thus passed through a nip formed in bonding calender 28 between heated steel roll 30 and patterned roll 32. The temperature of the heated rolls and the nip pressure should, of course, be selected so as to effect bonding without undesirable accompanying side effects such as excessive shrinkage or web degradation. When using polypropylene, for example, temperatures of about 275° F to 375° F in combination with nip pressures of about 500 to 600 pli on a 16 inch diameter roll have been found satisfactory. The pattern of raised points in roll 32 should be such that the total bonded area of the web (the combined area of the individual compacted areas) is about 5–50% of the total web area. Furthermore, the number of compacted areas in the web is also important. To an extent the denier of the filaments contained in the web influences the selection of an appropriate bond density with higher bond densities being useful with webs containing low denier filaments. In general, bond densities on the order of about 50–3200 compacted areas per square inch are useful with polymer filaments having deniers of about 0.5–10.

It will also be recognized that the present invention is useful in softening webs bonded by other means. For purposes of the present invention, it is only essential that the web have areas of varying bond intensity so that some portions are lightly bonded compared to other areas that are more highly bonded.

In accordance with the present invention, after passing through calender nip 28, bonded web 34 is heated to cause the lubricating agent to migrate to the fiber surfaces. Various heating means may be employed, and hot cans 36 are shown in the drawing by way of illustration. Preferably, the web is heated to a temperature in the range of from 180°–260° F with a range 220–240° F especially preferred. The particular temperature as well as the heating time will depend on factors such as the method of heating, the particular polymer, the basis weight, and the lubricating agent. However, generally, heating for a period of time in the range of from about 1 to about 7 seconds will be adequate when hot cans are used while longer times, for example, up to 60 seconds or more may be necessary when hot air convection heaters are utilized.

After heating, the softened web may be converted into the form desired or rolled into roll 38 shown on support rolls 40 and stored for further use.

It will be recognized that the heating and bonding steps may be reversed in which case the lubricating agent will have migrated to the filament surfaces prior to bonding substantially preventing the formation of secondary bonds.

EXAMPLE 1

A continuous filament nonwoven web having a basis weight of 1¼ oz./yd.$^2$ was formed by spinning polypropylene as described with reference to the sole FIGURE. The resulting web had the following properties: grab tensile of 26 lbs. in the machine direction and 28 lbs. in the cross direction; stretch of 40% in the machine direction and 50% in the cross direction; trapezoidal tear of 8.7 lbs. in the machine direction and 6.7 in the cross direction; opacity of 40 as measured by TAPPI Standard T-425-M-60; Ames bulk of 0.019 inch as measured on a single sheet; and handle as measured by a Model 5 Handle-O-Meter of 40 g. as an average of machine and cross directions. The Handle-O-Meter measures the force required to push a fabric through a slot opening with a blade approximately the same length as the opening. The softer or more pliable the fabric, the easier it moves through the opening. Stiffer fabrics require more force to be pushed through the opening. The degree of sheet bonding, therefore, affects its softness. The lower the Handle-O-Meter reading, the softer or more drapable the material. Specifically, "Hand" was determined according to TAPPI T 498SU66 using a Handle-O-Meter excpet that a 4 inch by 4 inch sample was used and tests were made on one side only since the material is not considered to be two-sided. A sample was placed on an instrument platform consisting of two plates which form a slot 0.25 inch (6.25 mm). The center line of the width of the fabric was aligned with the slot and/or penetrating blade used to force the specimen into the slot. The force required to do this was measured and reported in grams. Except where indicated, results reported are averages of machine and cross machine direction results. The Grab Tensile test is based on ASTM D1117–63 and measures the average force in pounds to separate a 4 inch × 6 inch sample of fabric. For fabrics that exhibit similar tensile strengths in the two major directions, the strength reported is an average between the MD and CD directions. The Trapezoidal Tear test is based on ASTM-D-2263 and measures the force in pounds required to cause a torn fabric to continue tearing at a medium rate of elongation (12 in./min.).

EXAMPLES 2–14

Example 1 was repeated except that lubricating agents as described in the following Table 1 were added in the concentrations indicated.

Table 1

| Example | Material | % Additive | H-O-M* | MW | HLB |
|---|---|---|---|---|---|
| 2 | (CONTROL B) | — | 38 | | |
| 3 | polyoxyethylene octyphenol ether (16 moles EO) (TRITON X-165) | 1.0 | 25 | 910 | 15.8 |
| 4 | polyoxyethylene nonylphenol ether (15 moles EO) (TRITON N-150) | 1.0 | 26 | 880 | 15.0 |
| 5 | polyoxyethylene lauryl ether (12 moles EO) (ETHOSPHERSE LA-12) | 1.0 | 24 | 713 | 14.8 |
| 6 | polyoxyethylene sorbitol hexoleate (50 moles EO) (ATLAS G-1096) | 1.0 | 26 | 3966 | 11.4 |
| 7 | polyoxyethylene octylphenol ether (9–10 moles EO) (TRITON X-100) | 1.0 | 24 | 628 | 13.5 |
| 8 | polyoxyethylene octyphenol ether (3 moles EO) (TRITON X-35) | 1.0 | ** | 338 | 7.8 |
| 9 | polyoxyethylene octyphenol ether (1 mole EO) (TRITON X-15) | 1.0 | ** | 250 | 3.6 |
| 10 | polyoxyethylene octyphenol ether (12–13 moles EO) (TRITON X-102) | 0.5 | 25 | 756 | 14.6 |
| 11 | ethoxylated oleyl alcohol (AMEROXOL OE-10) | 0.5 | 19 | 708 | 12.0 |
| 12 | ethoxylated oleyl alcohol (AMEROXOL OE-10) | 1.0 | 20 | 708 | 12.0 |
| 13 | POE (4) sorbitan monolaurate (TWEEN 21) | 0.5 | 21 | 524 | 11.1 |
| 14 | POE (4) sorbitan monolaurate (TWEEN 21) | 1.0 | 20 | 524 | 11.1 |

*Average of machine and cross directions, Handle-O-Meter values in grams.
**Did not bleed.

Since the "hand" tests are basis-weight dependent, the following examples illustrate results obtained on lighter webs.

EXAMPLES 15–31

Example 1 was repeated using 1.0 oz./yd.$^2$ basis weight webs as indicated in Table 2.

Table 2

| Example | Material | % Additive | H-O-M* | MW | HLB |
|---|---|---|---|---|---|
| 15 | (CONTROL #1) | — | 24 | | |
| 16 | (CONTROL #2) | — | 25 | | |
| 17 | sorbitan monolaurate (GLYCOMUL LC) | 1.0 | 17 | 348 | 8.6 |
| 18 | polyoxyethylene monostearate ester (14 moles EO) (HODAG 60S) | 1.0 | 16 | 884 | 13.6 |
| 19 | polyoxyethylene distearate ester (14 moles EO) (HODAG 62S) | 1.0 | 12 | 1168 | 10.4 |
| 20 | polyoxyethylene octyphenol ether (12–13 moles EO) (TRITON X-102) | 0.5 | 16 | 756 | 14.6 |
| 21 | polyoxyethylene sorbitol hexoleate (50 moles EO) (ATLAS G 1096) | 0.5 | 15 | 3966 | 11.4 |
| 22 | polyoxyethylene odyphenol ether (16 moles EO) (TRITON X-165) | 0.5 | 17 | 910 | 15.8 |
| 23 | polyoxyethylene lauryl ether (12 moles EO) (ETHOSPHERSE LA-12) | 0.5 | 15 | 713 | 14.8 |
| 24 | POE (14) monostearate (HODAG 60S) | 0.5 | 18 | 900 | 13.6 |
| 25 | POE (9) monostearate (HODAG 40S) | 0.5 | 16 | 680 | 11.1 |
| 26 | POE (9) monostearate (HODAG 40S) | 1.0 | 17 | 680 | 11.1 |
| 27 | Ethoxylated oleyl alcohol (AMEROXOL OE-10) | 1.0 | 8 | 708 | 12.0 |
| 28 | Ethoxylated oleyl alcohol (AMEROXOL OE-10) | 0.5 | 6 | 708 | 12.0 |
| 29 | POE (4) sorbitan monostearate (TWEEN 61) | 0.5 | 15 | 608 | 9.6 |
| 30 | POE (4) sorbitan monostearate (TWEEN 61) | 1.0 | 14 | 608 | 9.6 |
| 31 | POE (20) sorbitan tristearate (polysorbate 65) (TWEEN 65) | 1.0 | 17 | — | 10.5 |

*Average of machine and cross directions, Handle-O-Meter values in grams.

EXAMPLES 32–39

To illustrate the effect of additive molecular weight on migration, the webs as in Example 1 were made with varying amounts of additives and tested for amounts migrated to the fiber surface as shown in Table 3. The amount on the fiber surface was determined by extraction for 30 seconds at room temperature with isopropanol except for Hodag 40S which was extracted for two minutes in warm water and extracted for four hours with hexane to determine the total amount in the polymer.

Table 3

| Example | Additive | MW | HLB # | Total % in Polymer | % on Fiber Surface |
|---|---|---|---|---|---|
| 32 | Triton X-15 | 250 | 3.6 | 1.0 | 0.001 |
| 33 | Triton X-35 | 338 | 7.8 | 1.0 | 0.009 |
| 34 | Triton X-45 | 426 | 10.4 | 0.5 | 0.047 |
| 35 | Triton X-100 | 628 | 13.5 | 0.5 | 0.150 |
| 36 | Triton X-305 | 1526 | 17.3 | 1.0 | 0.087 |
| 37 | Triton X-705 | 3286 | 18.7 | 1.8 | 0.330 |
| 38 | Triton X-100 | 628 | 13.5 | 1.0 | 0.320 |

Table 3-continued

| Example | Additive | MW | HLB # | Total % in Polymer | % on Fiber Surface |
|---|---|---|---|---|---|
| 39 | Hodag 40S | 680 | 11.1 | 1.1 | 0.300 |

EXAMPLES 40–43

To illustrate that improved softening may be obtained with low levels of additives, Example 1 was repeated with the levels of Triton X-100 agent added to the polymer indicated in Table 4 and 1¼ oz./yd.$^2$ material produced.

Table 4

| Example | % Added to Polymer | Handle-O-Meter |
|---|---|---|
| 40 | 0.1 | 28 |
| 41 | 0.2 | 27 |
| 42 | 0.3 | 25 |
| 43 | 0.4 | 22 |

As the foregoing Tables demonstrate, the lubricating agents in order to migrate to the fiber surface must have an HLB number of at least about 8. As also shown, the present invention produces a dramatic improvement in Handle-O-Meter reading with a very low lubricating additive requirement. As a result, it is possible to produce very soft, nonwoven webs by adding only 0.10 to 3.0 percent by weight of the additives with a preferred range being 0.4 to 1.0 percent by weight.

While the Examples have utilized polypropylene webs, it is believed that the present invention is also applicable to any bonded thermoplastic fibers, especially polyolefins, but it may be more difficult to produce migration in polyesters and polyamides.

While it is not desired to limit the invention to any particular theory, it is believed that the lubricating agents of the present invention having high HLB numbers have a reduced solvent effect on the fibers thus avoiding an increase in bonding due to more plasticized fibers. Higher molecular weights also tend to increase the difficulty of migration so that molecular weights above 4000 are not considered useful. On the other hand, agents having molcular weights below 200 are too volatile to produce the desired lubricating effect.

The resulting softened, nonwoven webs of the present invention, in general, exhibit only a minor loss in strength properties and are extremely suitable for uses such as liners for disposable diapers and catamenial devices such a tampons and sanitary napkins. Preferred embodiments will contain 0.05 to 1.0 percent of the lubricant on the fiber surface. Especially preferred fabrics have 0.15 to 0.35% of the additive on the fiber surface.

It is apparent that there has been provided, in accordance with the invention, a method of softening nonwoven fabrics and resulting products that fully satisfy the objects, aims and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. A method of making a soft, nonwoven web comprising the steps of, mixing with a thermoplastic polymer 0.1% to 3.0% of a semi-compatible lubricating agent having a molecular weight in the range of from about 200 to about 4000 and an HLB number in the range of from about 8 to about 20;

extruding said mixture to form filaments;

collecting said filaments into a web;

pattern bonding said web to produce areas of relative high and low bond intensity; and heating said bonded web to a temperature in the range of from about 180° F to 260° F to cause said agent to migrate to the filament surfaces and substantially release said low intensity bonds.

2. The method of claim 1 wherein said thermoplastic polymer is a polyolefin and pattern bonding is obtained by passing the web through a patterned calender nip producing a total bonded area of 5 to 50% of the total web area and 50 to 3200 compacted high bond intensity areas per square inch.

3. The method of claim 2 wherein said polyolefin is polypropylene.

4. The method of claim 1 wherein said heating is obtained by contact with hot cans for one to seven seconds and said lubricating agent is caused to migrate to the filament surfaces to the extent that 0.05 to 1.0% of the lubricating agent can be measured on the filament surfaces.

5. The method of claim 1 wherein said heating is obtained by convection for up to 60 seconds and said lubricating agent is caused to migrate to the filament surfaces to the extent that 0.05 to 1.0% of the lubricating agent can be measured on the filament surfaces.

6. The method of claim 1 wherein the lubricating agent is a surfactant with an HLB number in the range of from 8 to 18 and a molecular weight in the range of from 300 to 800.

7. The method of claim 6 wherein the lubricating agent is uniformly mixed with the polymer in an amount of from 0.4 to 1.0% by weight.

8. A method of forming a soft, nonwoven web comprising the steps of, uniformly mixing with a polyolefin 0.1 to 3.0% by weight of a semi-compatible surfactant lubricating agent having a molecular weight in the range of from about 200 to about 4000 and an HLB number in the range of from about 8 to about 20;

extruding said mixture to form filaments;

collecting said filaments into a web;

pattern bonding said web to produce 50 to 3200 high intensity bond areas per square inch including 5 to 50% of the total web area and low bond intensity areas outside of said compacted areas; and heating said bonded web to a temperature in the range of from about 180° F to 260° F to cause said agent to migrate to the surfaces of said filaments to the extent that 0.05 to 1.0% of the lubricating agent can be measured on the filament surfaces and said low intensity bonds are substantially released.

* * * * *